US005447203A

United States Patent [19]

McLoughlin et al.

[11] Patent Number: 5,447,203

[45] Date of Patent: * Sep. 5, 1995

[54] REMOTELY ACTUATED FIREFIGHTING NOZZLE

[76] Inventors: John E. McLoughlin, 26 Southern Blvd., Nesconset, N.Y.; Neocles G. Athanasiades, 6 Maybeck Dr., East Setauket, N.Y. 11767

[ * ] Notice: The portion of the term of this patent subsequent to Nov. 16, 2010 has been disclaimed.

[21] Appl. No.: 50,974

[22] Filed: Apr. 19, 1993

Related U.S. Application Data

[63] Continuation-in-part of Ser. No. 731,492, Jul. 11, 1979, Pat. No. 5,261,494.

[51] Int. Cl.[6] ..... A62C 31/05

[52] U.S. Cl. ..... 169/70; 137/219; 137/883; 251/35; 251/44; 251/129.11; 251/215

[58] Field of Search ..... 169/5, 70; 239/154, 239/444, 441, 452, 453; 137/219, 883; 251/35, 44, 129.11, 215, 340

[56] References Cited

U.S. PATENT DOCUMENTS 2,984,418 5/1961 Dickmann et al. ..... 239/452 X
3,010,519 11/1961 Gillepie ..... 169/25
4,949,794 8/1990 Peitt et al. ..... 169/70 X
5,261,494 11/1993 McLoughlin et al. ..... 169/70
5,301,756 4/1994 Relyea et al. ..... 169/70 X

FOREIGN PATENT DOCUMENTS 353593 7/1931 United Kingdom ..... 169/70

*Primary Examiner*—Andrew C. Pike
*Attorney, Agent, or Firm*—Louise S. Heim

[57] ABSTRACT

A firefighting nozzle includes a nozzle body having a having a centrally formed jet orifice at its outlet end. An annular fog spray opening concentrically surrounds the jet orifice. A jet control valve is provided for allowing selective variation of the diameter of the solid stream emitted from the jet orifice. A fog control valve is provided for selectively varying the intensity of the discharge from the fog spray opening. The jet control valve and the fog control valve are operable independently of and simultaneously with one another, so that either a variable diameter solid stream or a variable fog cone, or both, can be produced at once. Various remote control arrangements are available for actuating the jet and fog control valves.

18 Claims, 9 Drawing Sheets

FIG. 6
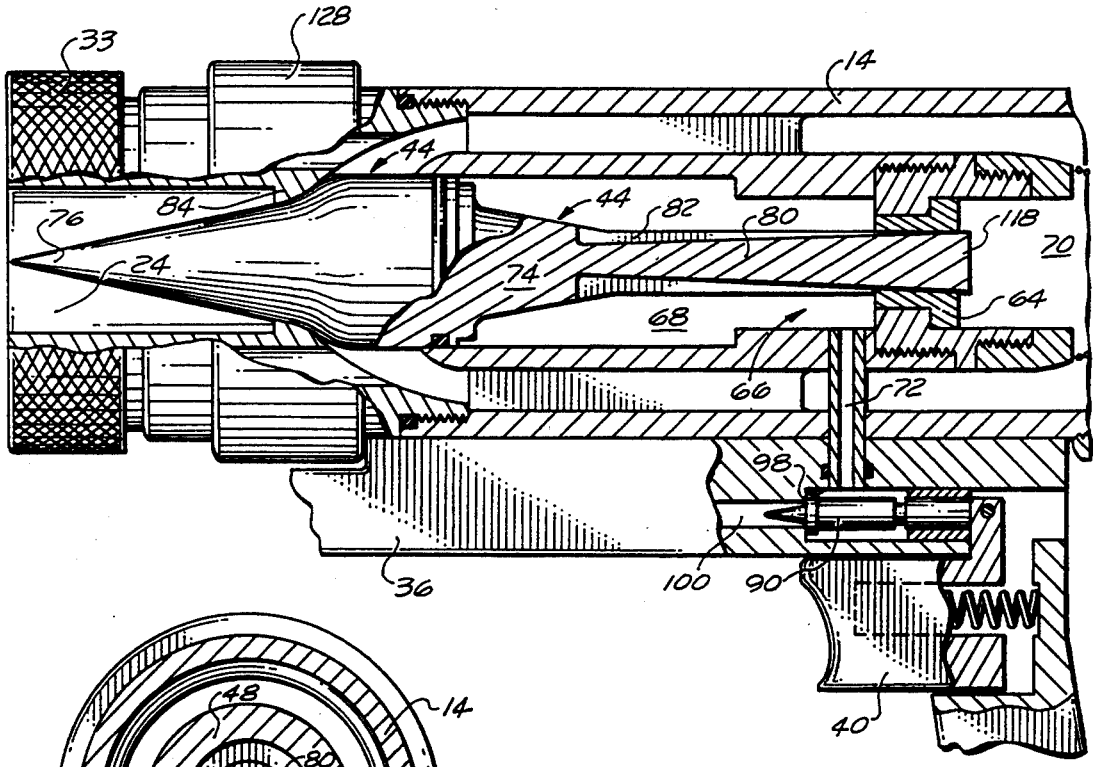
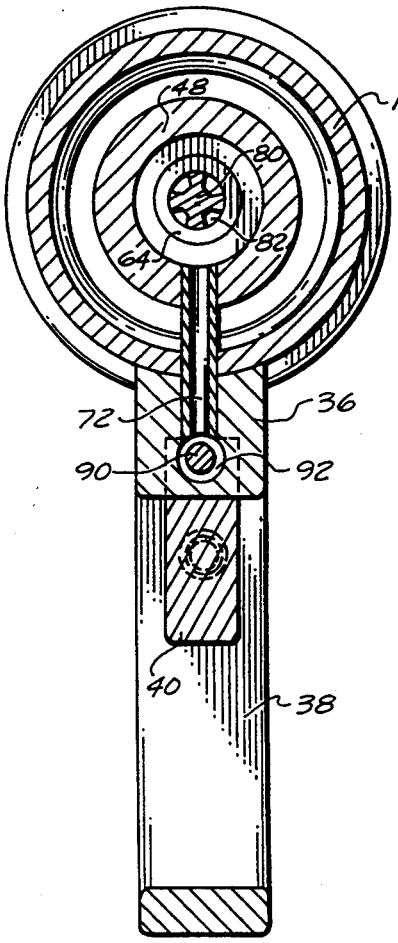
FIG. 7
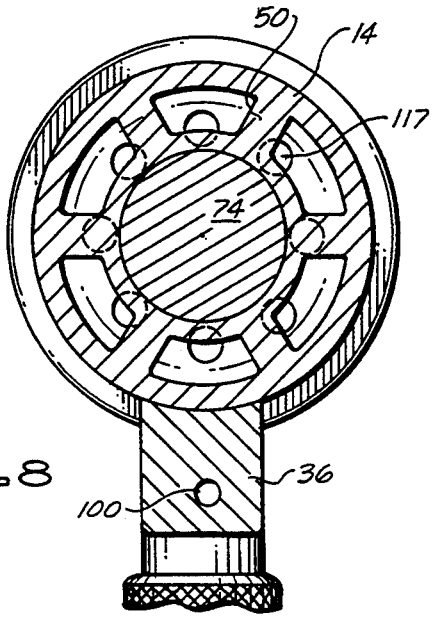
FIG. 8

REMOTELY ACTUATED FIREFIGHTING NOZZLE

CROSS-REFERENCE TO RELATED APPLICATION

This application is a continuation-in-part of our earlier U.S. patent application, Ser. No. 731,492, filed Jul. 17, 1991, now U.S. Pat. No. 5,261,494, issued Nov. 16, 1993.

BACKGROUND OF THE INVENTION

1. Field of the Invention

This invention relates to the art of firefighting equipment.

More particularly, this invention relates to a spray nozzle for attachment to a fire hose.

In a further and more specific aspect, the instant invention concerns a firefighting nozzle capable of discharging a variable solid stream and a variable fog spray, with controls for each type of spray being operable independently of and simultaneously with one another.

2. Description of the Prior Art

Firefighting nozzles can be broadly classified into two basic types. The oldest and simplest type of nozzle, known as the solid stream or straight tip nozzle, consists essentially of a tapered cone secured to the end of a fire hose, with a quarter-turn ball valve or similar device incorporated into the nozzle opening for controlling the flow of water. A more modern type of nozzle, known as an automatic nozzle, incorporates a spring-biased disc into the discharge opening for maintaining a substantially constant pressure in the nozzle. Each of the foregoing nozzles has its own advantages and disadvantages which makes it more suitable for certain applications than for others.

The primary advantage of the solid stream nozzle, for instance, is that it concentrates the water from the fire hose into a high force, high velocity, circular stream which is extremely effective in "punching through" fires and burning debris to extinguish flames. A drawback of this type of nozzle, however, is that a very high reaction force is generated by the flow when the control valve is fully opened, making the nozzle difficult and sometimes unsafe for a fireman to handle. The reaction force can be decreased by partially closing the control valve, but this creates severe turbulence in the nozzle, which causes the quality of the stream to deteriorate, and reduces the reach of the stream.

Still another problem encountered with the solid stream nozzles is that tips of various exit orifice diameter must be attached to the nozzle, depending on the available water pressure, water volume, and the number of firefighters available to handle the hose. The necessity to change tips is inconvenient and can cause dangerous delays in responding to a fire.

As a result of the above drawbacks of solid stream nozzles, the automatic nozzle has become more widely used in the United States. One key advantage of the automatic nozzle is that the constant pressure feature allows for a constant reach of the water stream regardless of pressure oscillations at the source. In addition, the automatic nozzle easily incorporates a feature known as "fog generation", which allows the nozzle to emit a conical spray of evenly distributed water droplets. This is done by forming a number of inwardly and forwardly projecting rods or teeth along the inner circumference of the discharge orifice. These teeth cause the water to variably change direction and to be emitted in all directions of the included solid angle of a cone. The resultant fog is highly desirable, since it spreads over a relative wide area, forming a protective shroud cooling the flames in the immediate vicinity of the firefighter. The advantages of this type of nozzle are somewhat diminished, however, by its inability to produce the same type of highly concentrated, forceful stream which is available in a solid stream nozzle for punching through burning debris.

A third type of nozzle, known as the Navy nozzle, consists of a straight tip nozzle and a fog-generating nozzle, provided one above the other. A diverter valve allows the operator to choose which nozzle to use. Even this arrangement is not entirely satisfactory, however, since only one option is available at a time, and the choice of which type of stream to use in a given situation is not always a clear-cut or easy one.

It would be highly advantageous, therefore, to remedy the foregoing and other deficiencies inherent in the prior art.

OBJECTS OF THE INVENTION

Accordingly, it is an object of the present invention to provide a firefighting nozzle capable of producing a solid stream and a fog spray simultaneously.

Another object of the invention is the provision of a nozzle having two orifices for producing different types of spray, and independently operable valves for controlling the flow through each orifice.

And another object of the invention is to provide a firefighting nozzle having a valve for varying the diameter of a solid stream, eliminating the need for different sized tips.

Still another object of the invention is the provision of hydraulically-controlled valves for varying the discharge from a firefighting nozzle.

Yet another object of the invention is to provide a firefighting nozzle with conveniently located fingertip controls which allow the operator to keep both hands on the nozzle at all times.

Yet still another object of the invention is the provision of a firefighting nozzle with a trigger-actuated control for producing a variable-diameter solid stream, wherein the solid stream shuts off automatically when the trigger is released.

And a further object of the invention is to provide a firefighting nozzle with a twist-actuated fog spray valve which remains open if the nozzle is dropped.

And still a further object of the invention is to provide a firefighting nozzle with fog-generating capability and a shaper ring for continuously varying the included angle of the fog cone.

And yet a further object of the invention is to provide a firefighting nozzle with means for controlling the reaction force generated by the nozzle.

A still further object of the invention is the provision of a variety of different arrangements for remotely controlling a firefighting nozzle.

And yet still a further object of the invention is to provide a firefighting nozzle, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, a firefighting nozzle is provided with independently variable solid stream and fog spray capability. The nozzle comprises a hollow body having a centrally formed jet orifice at its outlet end. A annular fog spray opening concentrically surrounds the jet orifice. A jet control valve is provided in the jet orifice for allowing selective variation of the diameter of the solid stream discharged from the orifice. A fog control valve is provided in the fog spray opening for selectively varying the intensity of the flow through the opening. In addition, a shaper ring is provided for selectively varying the included angle of the fog cone.

In a preferred embodiment of the invention, the jet control valve consists of a valve body mounted for longitudinal movement toward and away from a valve seat provided near the outlet end of the nozzle. The rear portion of the valve body extends into a hydraulic chamber having an inlet and an outlet. A needle valve controls flow through the outlet of the hydraulic chamber, thus controlling the amount of pressure exerted on the valve body. The needle valve is actuated by a manually controlled trigger movably connected to a rear grip depending from the nozzle body. The distance from the jet valve body to the valve seat, and thus the diameter of the discharged solid stream and the resulting reaction force, is dependent on the force exerted on the trigger.

The fog control valve comprises an annular valve body mounted for reciprocation toward a valve seat defining the inner circumference of the annular fog spray opening. The rear portion of this valve body also extends into a hydraulic chamber having an inlet and an outlet. The outlet is controlled by a twist-actuated metering valve mounted in a front grip depending from the nozzle body. The fog valve is opened an amount proportional to the amount of twist on the metering valve. The metering valve retains its position even if the nozzle is dropped, so that a protective spray is always available for protecting the firefighters. In addition, for safety reasons, the shaper ring is mounted such that it returns to its widest spray position when its control lever is released, so that reaction forces are minimal.

In other embodiments, the manually actuated needle valve for controlling the jet control valve and the twist-actuated metering valve for controlling the fog control valve are replaced by remote actuators.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 6 is a view similar to FIG. 5, with the jet control valve fully closed;

FIG. 7 is a cross-sectional view taken through line 7—7 of FIG. 5;

FIG. 8 is a cross-sectional view taken through line 8—8 of FIG. 5;

DETAILED DESCRIPTION OF THE PREFERRED EMBODIMENTS

Figure 1:
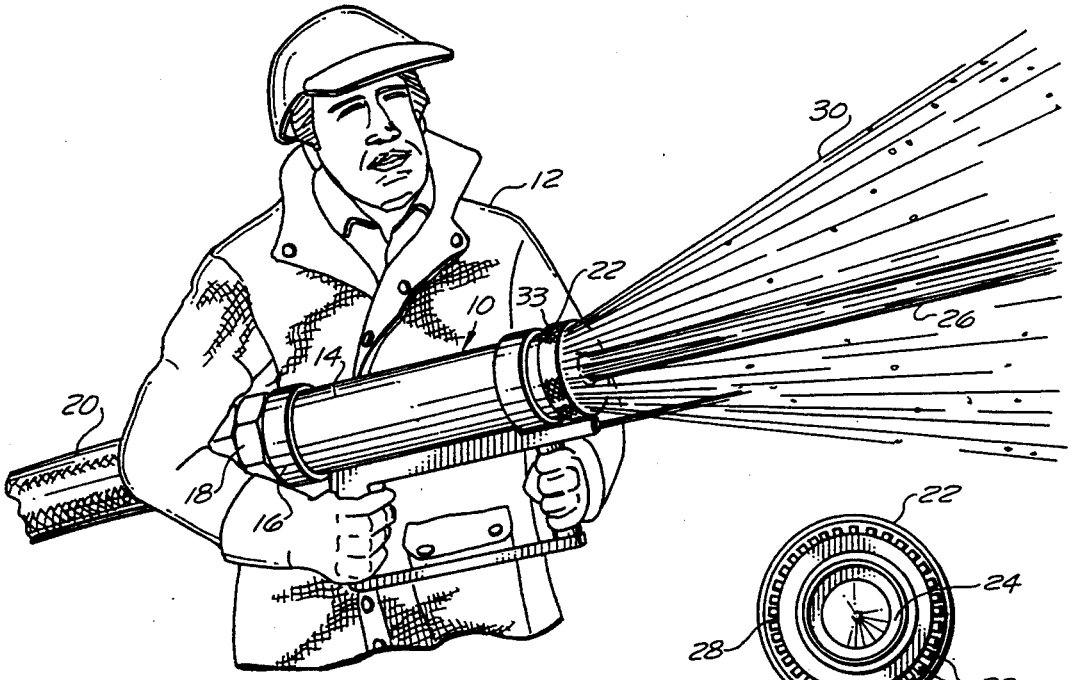
FIG. 1 is a perspective view showing a firefighter operating a nozzle according to the instant invention.
Figure 3:
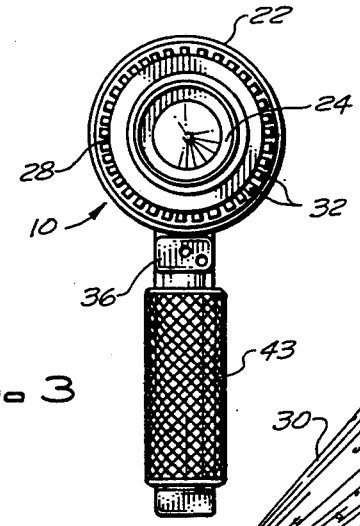
FIG. 3 is a front view of the nozzle.
Figure 2:
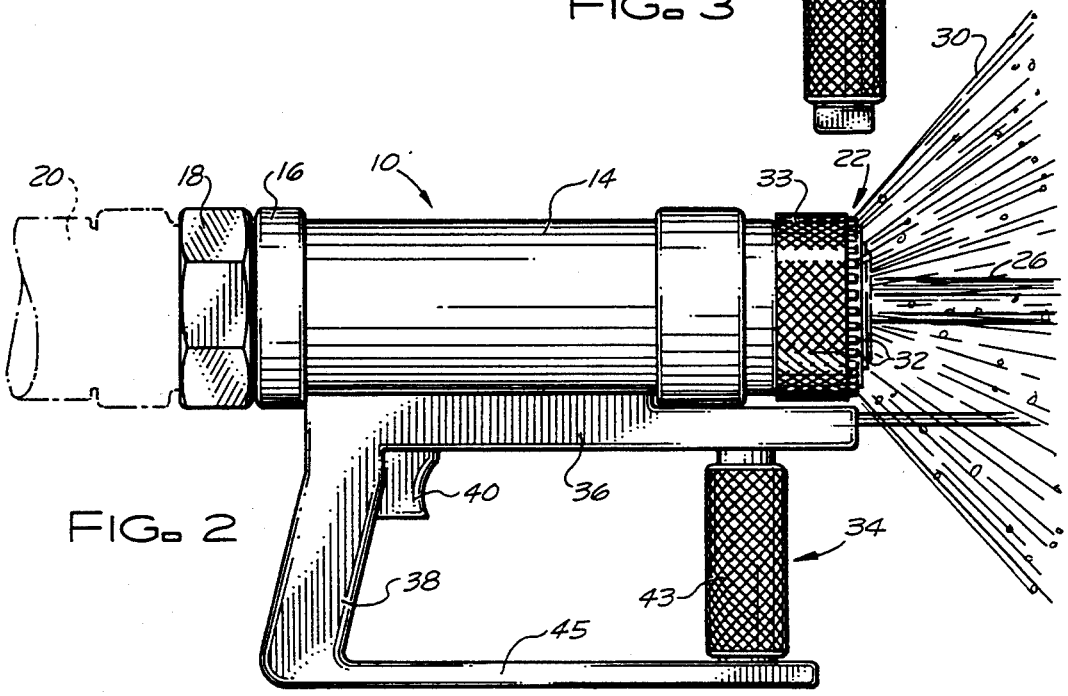
FIG. 2 is a side view showing the nozzle of FIG. 1.

Turning now to the drawings in which like reference characters indicate corresponding elements throughout the several views, attention is first directed to FIG. 1, which shows the nozzle according to the present invention, indicated in its entirety by the numeral 10, being manipulated by a firefighter 12. With further reference to FIGS. 2 and 3, the nozzle 10 comprises a generally cylindrical nozzle body or outer housing 14 having an inlet end 16 secured by a swivel coupling 18 to a conventional fire hose 20. The outlet end 22 of the nozzle body 14 defines a central jet orifice 24 for discharging a circular, solid stream 26 of liquid. The jet orifice 24 is concentrically surrounded by an annular fog spray opening 28 for discharging a conical spray or fog 30, made up of liquid droplets which are evenly distributed throughout the cone. The droplets are produced by a plurality of inwardly curved, forwardly projecting teeth 32 formed along the circumference of the fog spray opening 28. A shaper ring 33 is moveably mounted at the outlet end 22 of the nozzle body 14, for allowing adjustment of the included angle of the fog cone 30.

A specially configured gripping assembly 34 is provided on the underside of the nozzle body 14. The gripping assembly 34 includes an upper support bas 36, a rear pistol grip 38 having a manually actuable trigger 40, and a front grip 42 having a twist actuator 43 with a knurled outer surface. A lower guard bar 45 extends between rear grip 38 and front grip 42, preventing the hose 20 or other object from becoming entangled in the gripping assembly and accidentally depressing the trigger 40. The function and structure of trigger 40 and twist actuator 43 will be described shortly.

Figure 4:
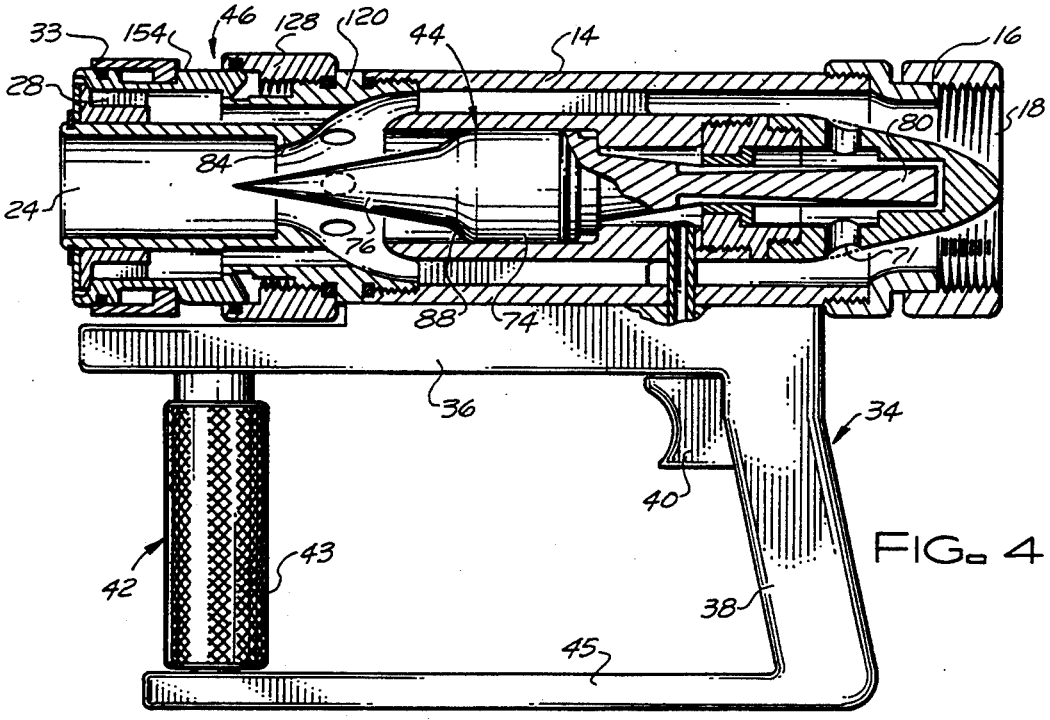
FIG. 4 is a longitudinal sectional view of the nozzle, with details of the handle and controls eliminated for purposes of clarity.

Turning now to FIG. 4, a jet control valve 44 is provided for controlling the discharge of liquid through the jet orifice 24. Specifically, the jet control valve 44 allows the diameter of the circular solid stream 26 to be selectively varied. In addition, a fog control valve 46 is provided for controlling the discharge of liquid through the annular fog spray opening 28. The jet control valve 44 and fog control valve 46 are operable both simultaneously with and independently of one another.

The structure and operation of the jet control valve 44 can be best understood by referring to FIGS. 5–9. As can be seen most clearly in FIG. 9, the jet control valve 44 includes an interior valve housing 48, which is located in spaced relationship to the inner sidewall of the outer housing 14 by a plurality of radially extending straightening vanes 50. For ease of manufacturing, the interior valve housing 48 is preferably constructed as a three-piece body, including a generally tubular front member 52 having an open front end 54 and an internally threaded, open back end 56; a rear member 57 having an internally threaded, open, front end 58 and a closed back end 60; and a generally tubular, central connector member 62 having both ends externally threaded for cooperation with the corresponding internally threaded ends of the front and rear members 56, 57. A sleeve bearing 64 is carried in the bore of the connector member 62.

Figure 5:
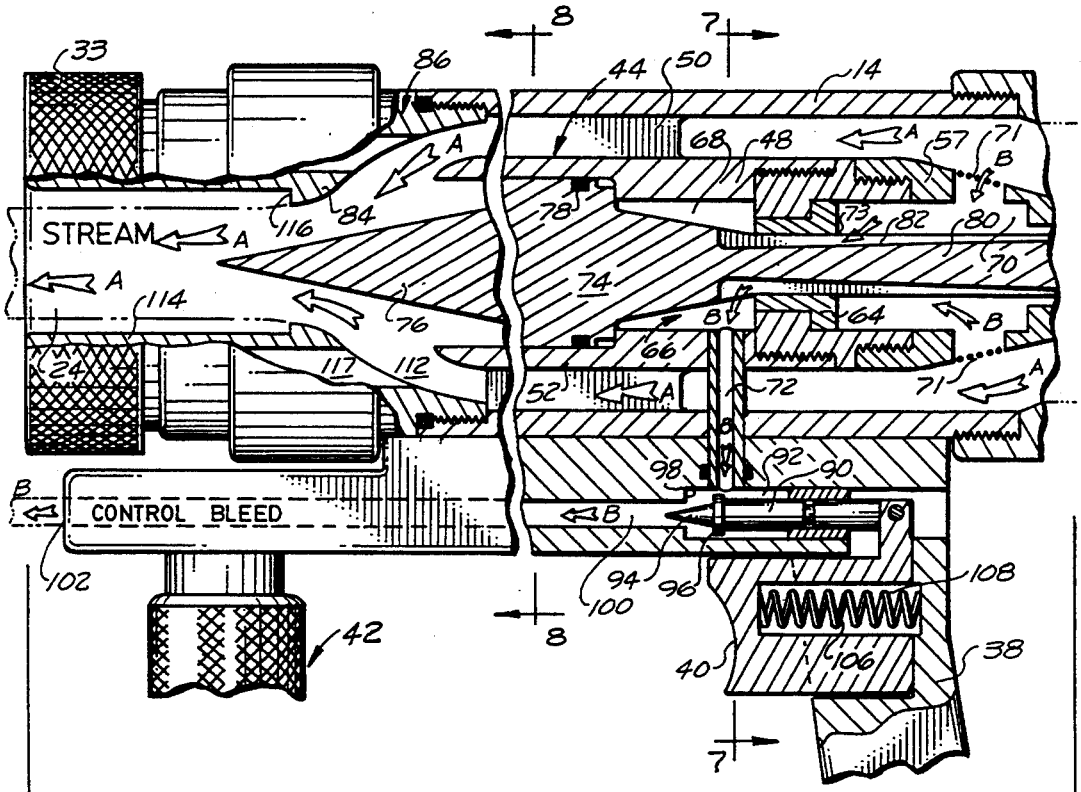
FIG. 5 is an enlarged fragmentary sectional view showing the rear portion of the nozzle, with the jet control valve fully opened.
Figure 9:
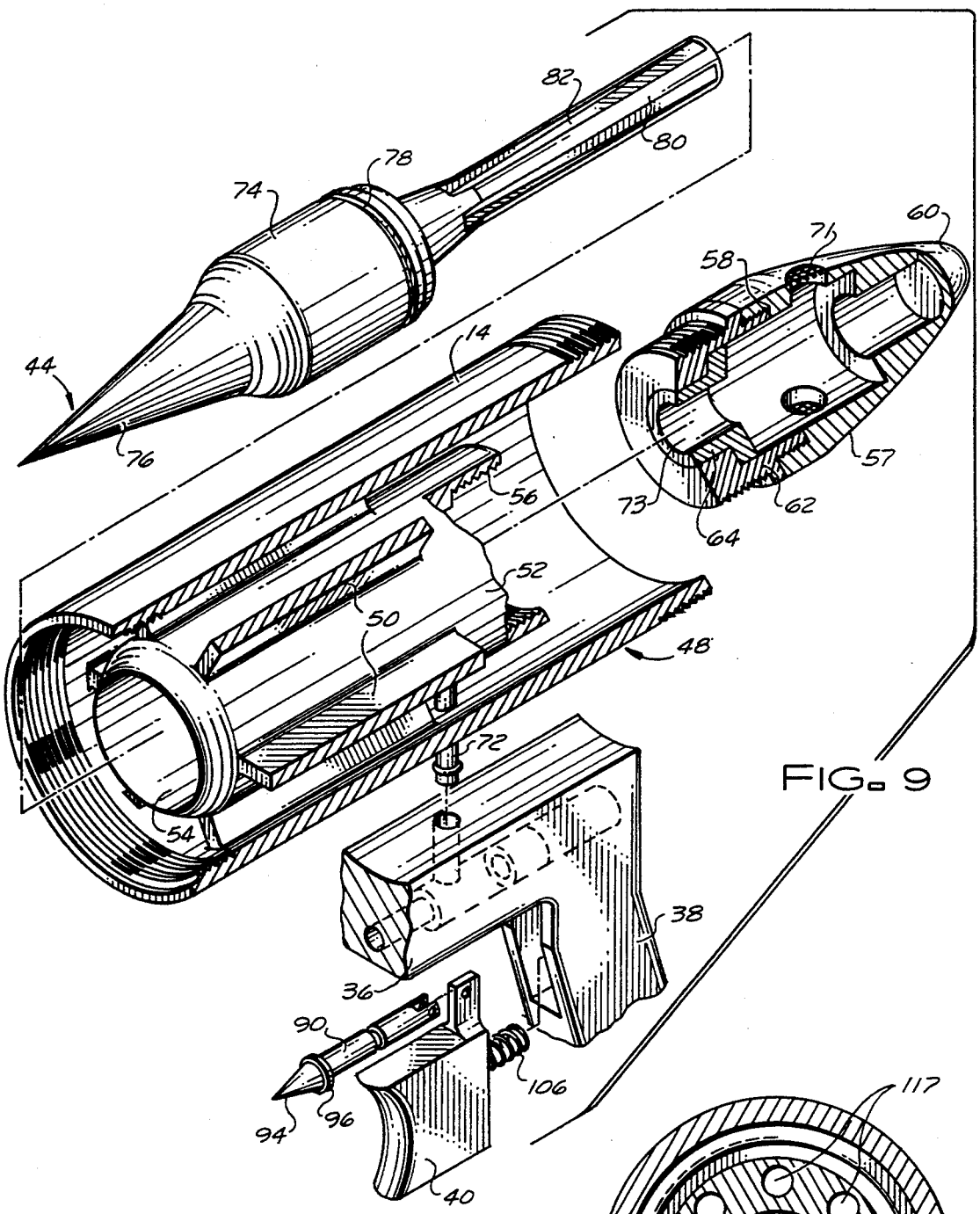
FIG. 9 is an exploded perspective view showing the components of the jet control valve and its associated controls.
Figure 13:
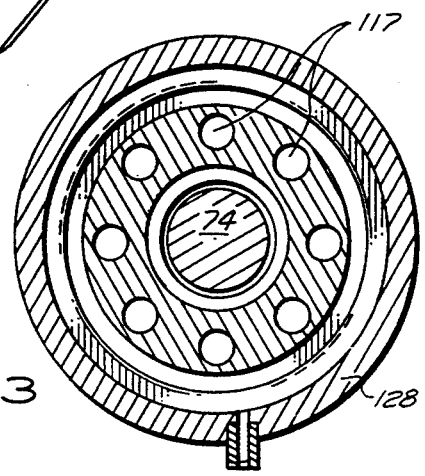
FIG. 13 is a cross-sectional view taken through line 13—13 of FIG. 10.

With additional reference to FIG. 5, the interior valve housing 48 defines a hydraulic chamber 66, consisting of a front chamber 68 carried in the front member 52 and a rear chamber 70 carried in the rear member 57. A plurality of circumferentially spaced apart, meshed covered openings 71 formed in the sidewall of the rear chamber 70 serve as inlets for admitting filtered liquid into the rear chamber 70. An outlet passage 72 extending through the sidewall of the front member 52 discharges liquid from the front chamber 68. The bore 73 of the sleeve bearing 64 defines a flow passage connecting the two chambers 68, 70.

A valve body 74 having a forwardly tapered front end 76 is mounted for longitudinal translation within the hydraulic chamber 66. A sealing ring 78 carried on an intermediate portion of the valve body 74 prevents liquid in the hydraulic chamber 66 from escaping past the front end 58. In addition, the valve body 74 includes an elongated tail portion 80 which extends rearwardly through the sleeve bearing 64. A plurality of longitudinally extending grooves 82 are machined or otherwise formed in the tail portion 80. The depth of the grooves 82 increases toward the front of tail portion 80.

An annular valve seat 84 is formed forwardly of the valve body 74. The valve seat 84 is formed along the rear inner surface of a specially configured tip assembly 86, which will be described in greater detail shortly, in connection with the fog control valve 46. The surface of the valve seat 84 is preferably tapered or contoured to match the taper or contour of the base portion 88 of the conical front end 76 of the valve body 74, so that a tight seal is formed when the valve body 74 is in its full forward position, as shown in FIG. 6.

The movement of the valve body 74 relative to the valve seat 84 is controlled by varying the pressure in the front chamber 68 of the hydraulic chamber 66. This pressure is controlled by a needle-type metering valve 90, which is mounted for longitudinal reciprocation in a control passage 92 communicating with the outlet passage 72 from the front chamber 66. The control passage 92 comprises a chamber formed in the upper support bar 36 of the nozzle grip assembly 34, extending perpendicular to the outlet passage 72.

The needle valve 90 includes a suitably shaped front end 94, the base 96 of which resides against an annular valve seat 98 at the forward end of the control passage 92, when the valve 90 is in its fully forward position. As the valve 90 moves back, away from the valve seat 98, liquid in the control passage 92 is allowed to escape past the front end 94 of the needle valve 90, into a relief duct 100 extending longitudinally through the support bar 36. Liquid in the relief duct 100 exits as a forwardly directed stream through an outlet 102 formed in the front end of the support bar 36.

The needle valve 90 is mechanically coupled to a trigger 40 moveably mounted in the rear grip 38. The trigger 40 is biased to a full forward position by a spring 106 having one end secured to the grip 38 and another end carried in a cavity 108 formed in the trigger 40. Thus, the trigger automatically returns to the forward position when released, forcing the needle valve 90 against the valve seat 98, and shutting off the flow from the jet stream orifice 24. This is an important safety feature, since the high reaction forces generated by the jet stream could cause the hose 20 to whip around dangerously, injuring firefighters, if the jet stream valve 44 were to remain open if the nozzle 10 was dropped.

FIG. 5 illustrates the flow of liquid through the nozzle 10 when the trigger 40 is in its completely retracted position, fully opening needle valve 90 and jet control valve 44. Pressurized liquid enters through the inlet end 16 of the nozzle 10 and flows around the interior valve housing 48 and past the straightening vanes 50, as indicated by arrows A. The liquid then enters the tip assembly 86 through a smooth-walled flow passage 112 which continuously diminishes in area in the forward direction, slowly accelerating the flow to produce a more stable liquid jet. From the flow passages 112, some of the liquid enters an outlet tube 114. The flow passages 112 form a sharp corner 116 with the outlet tube 114, allowing the liquid to make a "clean break". Any liquid not entering the outlet tube 114 flows into the fog spray opening 28 via a plurality of circumferentially spaced apart openings 117 formed in the wall of the flow passage 112, as will be described shortly.

In addition to the liquid flowing around the interior housing 48, a small amount of liquid enters the hydraulic chamber 66 through openings 71 in the rear member 57, as shown by Arrows B. The liquid travels from rear chamber 70 to the front chamber 68 via the grooves 82 in the tail portion 80 of the valve body 74, which allow maximum flow through the sleeve bearing 64 when the valve body 74 is fully aft. From the front chamber 68, the liquid enters the outlet passage 72, passes around the front end 94 of the shaped needle valve 90 into the relief duct 100, finally exiting through the outlet 102. Because of the continuous discharge of liquid through the outlet passage 72 and relief duct 102, the pressure in the hydraulic chamber 66 is always minimum, allowing the jet control valve body 74 to remain fully aft until the trigger 40 is released.

FIG. 6 illustrates the valve configuration when the trigger 40 is released, closing the needle valve 90 and the jet control valve 44. In this configuration, the needle valve 90 resides against the valve seat 98, shutting off the flow from the outlet passage 72 to the relief duct 100. As a result, the pressure in the front chamber 68 of the hydraulic chamber increases, forcing the valve body 74 forwardly until the base portion of the tapered front end 76 sealingly engages the valve seat 84, cutting off flow to the outlet tube 114. In addition, when the valve body 74 is in its fully forward position, the rear end 118 of the tail 80 allows minimum leakage into the hydraulic chamber, maintaining the valve body 74 in its forward position.

Although not specifically illustrated, it will be clear to the skilled practitioner that the trigger 40 may be held in any position intermediate the two extremes shown in FIGS. 5 and 6. As the trigger 40 is retracted, the valve body 74 moves away from the valve seat 84 by an amount proportional to the pull on the trigger, thus increasing the area between the front end 76 of the valve and the valve seat 84, resulting in a jet of greater diameter. Since the reaction force generated by the stream varies in proportion to its size for a given pressure, the nozzle operator is able to simply and quickly adjust this force to its safest, most effective level merely by varying the pull on the trigger 40.

Figure 10:
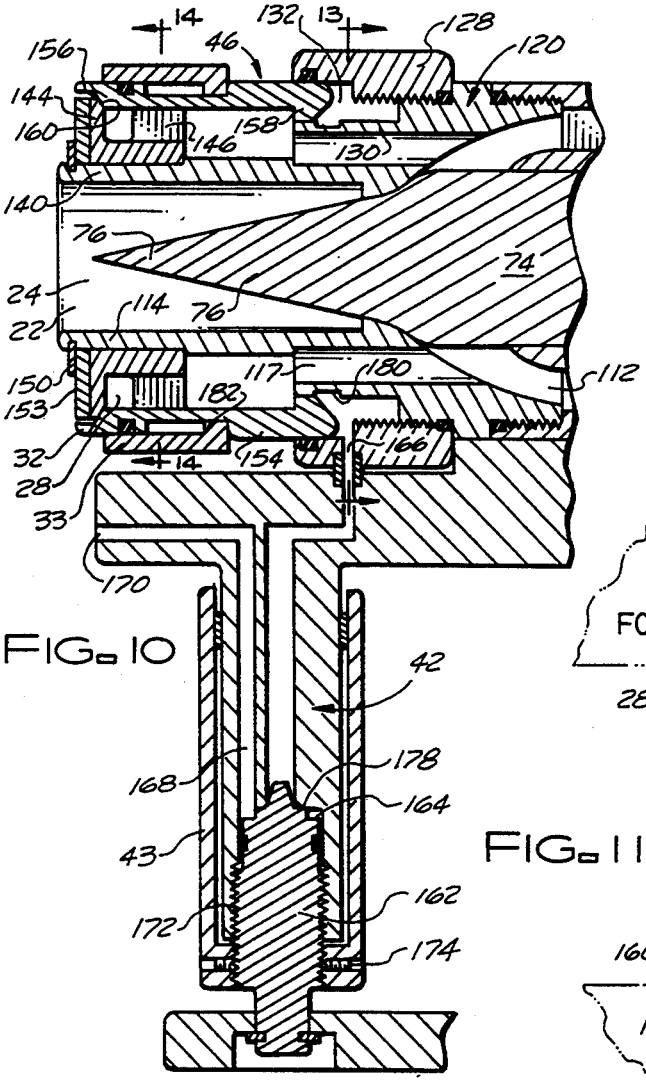
FIG. 10 is a an enlarged fragmentary longitudinal cross section, showing the front portion of the nozzle, with both the jet control valve and the fog control valve fully closed.
Figure 14:
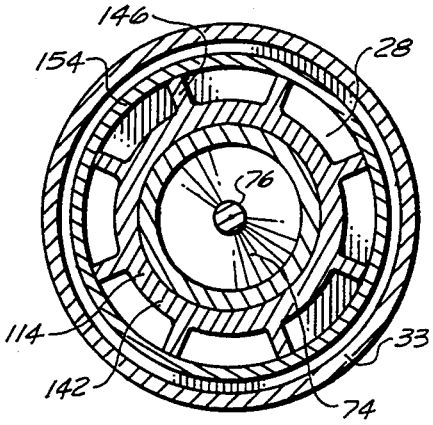
FIG. 14 is a cross-sectional view taken through line 14—14 of FIG. 10.
Figure 15:
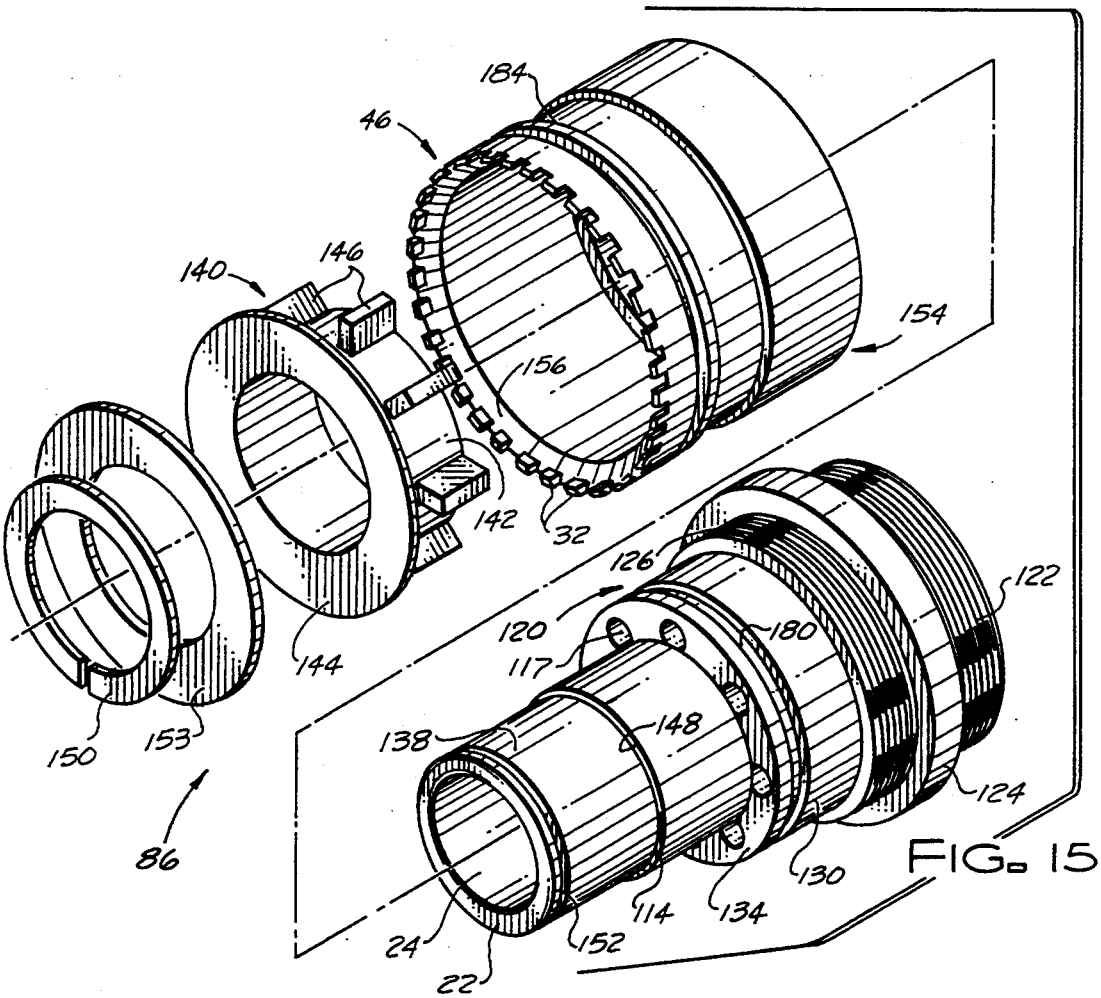
FIG. 15 is an exploded perspective view showing the front portion of the nozzle body and the fog control valve, with the housing nut and shaper ring omitted for purposes of clarity.

Flow downstream of the jet control valve 44 may be best understood by referring to FIG. 15, which shows the components of the tip assembly 86, and also to the longitudinal cross-sections in FIGS. 4 and 10. The tip assembly 86 includes a generally cylindrical main body 120 having an externally threaded rear end 122 for attachment to the front end of the nozzle body 14. A radially extending flange 124 separates threaded end 122 from a second externally threaded portion 126, on which an internally threaded housing nut 128 is mounted. The outer diameter of the main body 120 is reduced forwardly of the threaded portion 126 to form a boss 130. A hydraulic chamber 132 is defined between the boss 130 and the inner surface of the housing nut 128.

The outer diameter of the main body 120 is reduced still further forwardly of the boss 130, forming outlet tube 114. The front end of the boss 130 extends perpendicularly to the outlet tube 114, forming an annular end wall 134. A plurality of bores or openings 117 extend longitudinally from the annular end wall 134 to the rear inner surface of the main body 120, where they intersect with the flow passages 112 described earlier, in connection with FIG. 5.

The outer surface of the outlet tube 114 is stepped slightly inwardly at a location halfway between annular wall 134 and the outlet end 22 to form a reduced diameter front portion 138 on which a spacer ring 140 is mounted. The spacer ring 140 comprises an annular body 142 having a flange 144 extending radially outwardly from its forward end. A plurality of positioning vanes 146 extend radially outwardly from and longitudinally along the annular body 142. The spacer ring 140 is clamped against the step 148 in the outlet tube 114 by a split retaining ring 150 carried in a groove 152 formed at the outlet end 22 of the tube 114. An O-ring 153 is interposed between the spacer ring 140 and the retaining ring 150.

An annular valve body 154 is supported by the positioning vanes 146, and mounted for longitudinal movement along the outer surface of the outlet tube 114. The space between the valve body 154 and the outlet tube 114 defines the annular fog spray opening 28. The front end of the valve body 154 comprises a tapered surface 156 which terminates in forwardly projecting teeth 32. The rear end of the valve body 154 includes an inwardly projecting flange 158 which extends into the hydraulic chamber 132. When the valve body 154 is in its fully forward position, as shown in FIG. 10, the bottom edge of the flange 158 engages the outer surface of the boss 130, minimizing flow between the fog spray opening 20 and the hydraulic chamber 132. At the same time, the tapered front surface 156 of the valve body engages the rear outer surface of the spacer ring 140, which functions as a valve seat 160. Together, the annular valve body 154 and the valve seat 160 are the primary components of the fog control valve 46.

The operation of the fog control valve 46 is generally similar to the operation of the jet control valve 44. That is, the movement of the valve body 154 is controlled by varying the pressure in the hydraulic chamber 132. The pressure in the chamber 132 is controlled by a metering valve 162 mounted in a control passage 164 formed in the front grip 42 of the grip assembly 34. The control passage 164 communicates with both an outlet passage 166 extending from the hydraulic chamber 132 and a bleed passage 168 extending through the front grip 42 and the upper support bar 36. The bleed passage 168 terminates in an outlet 170, which allows water to exit as a forwardly directed stream.

In contrast to the needle valve 90 governing the jet control valve 44, which is mounted solely for longitudinal movement, the metering valve 162 for the fog valve 46 is rotatably mounted, and is retained within the front grip 42 by screw threads 172. The valve 162 is secured by set screws 174 to a twist actuator 43 mounted for rotation about the front grip 42. The screw threads 172 convert the twisting movement of the actuator to a longitudinal movement of the metering valve 162 toward or away from its seat 178. In addition, the screw threads 172 retain the valve 172 in its most recent position when the actuator 43 is released. Thus, the control valve 46 can be remain open even when the nozzle 10 is dropped, so that the protective, cooling effects of the fog spray are not lost.

Figure 11:
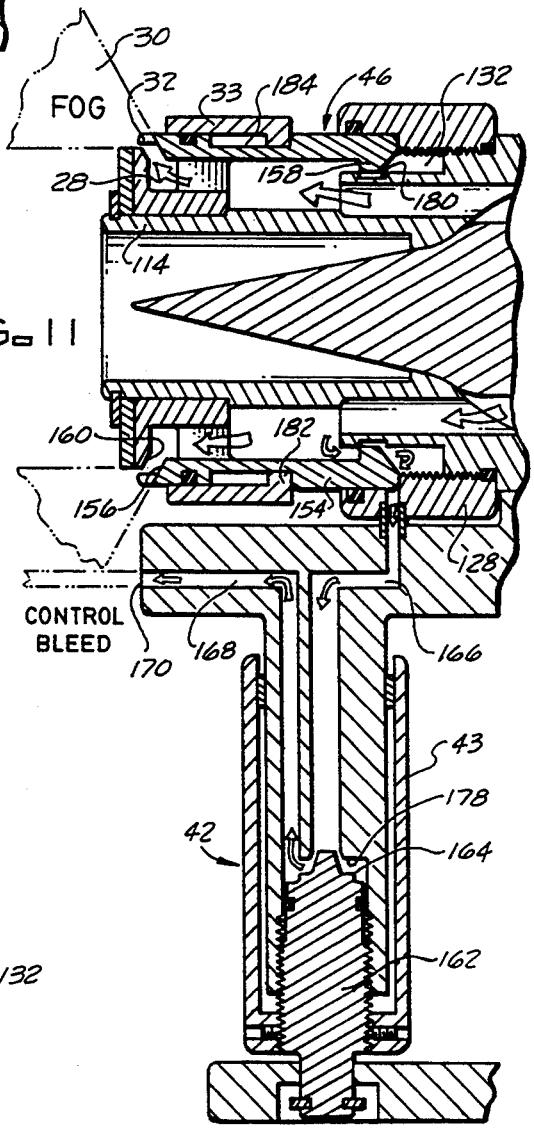
FIG. 11 is a view similar to FIG. 10, with the jet control valve closed, the fog control valve fully opened, and the shaper ring fully aft.

Operation of the fog control valve 46 may be understood by referring to FIGS. 10 and 11. When the valve is fully closed, as shown in FIG. 10, liquid entering the annular flow opening 28 through the bores 117 in the tip assembly 86 exerts a rearward pressure on the rear flange 158 of the valve body 154. This pressure is counteracted by forward pressure in the hydraulic chamber 132, causing the valve 46 to remain closed. However, as soon as the twist actuator 43 is rotated, causing the metering valve 162 to move away from its seat 178, the pressure in the hydraulic chamber 132 decreases, allowing the valve body 154 to move rearwardly. As the valve body 154 moves rearwardly, its rear flange 158 passes over a groove 180 formed in the front end of the boss 130 projecting from the main body 120. The clearance between the bottom edge of the flange 158 and the bottom wall of the groove 180 allows more liquid to flow into the hydraulic chamber 132, and then out again through the outlet passage 166 and bleed passage 168. At the same time, the tapered front surface 156 of the valve body 154 moves away from the valve seat 160 allowing liquid to exit from the fog orifice 28. Fluid exiting through the orifice 28 impinges on the forwardly directed teeth 32, which direct the flow in all directions, creating a conical "fog" 30 of evenly distributed droplets.

The included angle of the fog cone 30 may be selectively varied by manipulation of the shaper ring 33, which consists of an annular member having an inwardly extending flange 182 formed at its rear end. The flange 182 is disposed for sliding movement in a recess extending annularly around the valve body 154. Although not specifically illustrated, a control ring or lever may be provided on the shaper ring for allowing manual control of the shaper ring's movement. Such a ring or lever preferably depends from the underside of the shaper ring 33 and is readily accessible from the front grip 42, so that an operator can grasp it with a thumb or other finger, without removing his hand from the twist actuator 43.

Figure 12:
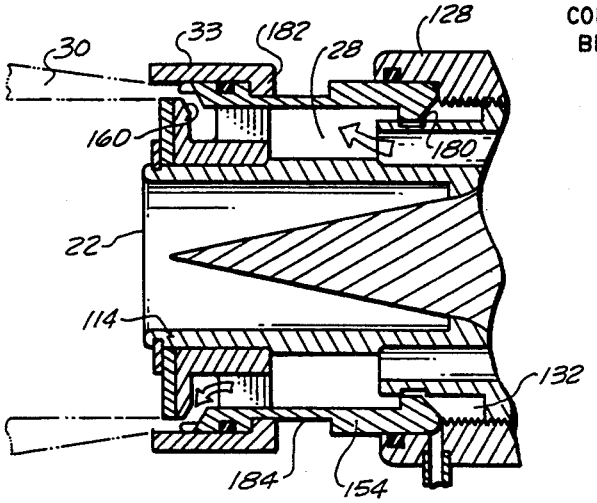
FIG. 12 is a view similar to FIG. 11, with the jet control valve closed, the fog control valve fully opened, and the shaper ring fully forward.

FIG. 11 shows the shaper ring 33 in its fully aft position, which results in the widest possible fog cone angle. FIG. 12 shows the shaper ring 33 in its fully forward position. In this position, the front end of the ring 33 projects forwardly, beyond the valve seat 160 and the front end 22 of the nozzle, thus forming a ceiling which narrows the fog cone to its minimum included angle. Other than this, the flow of liquid in FIG. 12 is exactly the same as in FIG. 11. The shaper ring 33 is mounted on the valve body 154 in such a way that the reaction forces created by the exiting liquid automatically force the ring 33 to the fully aft position shown FIG. 11 when the control lever is released, since the widest angle cone is safest.

Although FIGS. 10–12 show the fog valve 46 only in its fully open and fully closed position, and the shaper ring 33 fully forward and fully aft, it will be evident that both the fog valve 46 and the shaper ring 33 can be independently maintained in any position intermediate these extremes. It will also be evident that, although FIGS. 10–12 show the jet control valve 44 fully closed, the fog control valve 46 and shaper ring 33 can also be operated when the jet control valve 44 is fully open, or in an intermediate position. The state of the fog control valve 46 is not in any way dependent on the state of the jet control valve, and vice versa. Thus, an infinitely variable combination of discharge patterns is obtainable.

Figure 16:
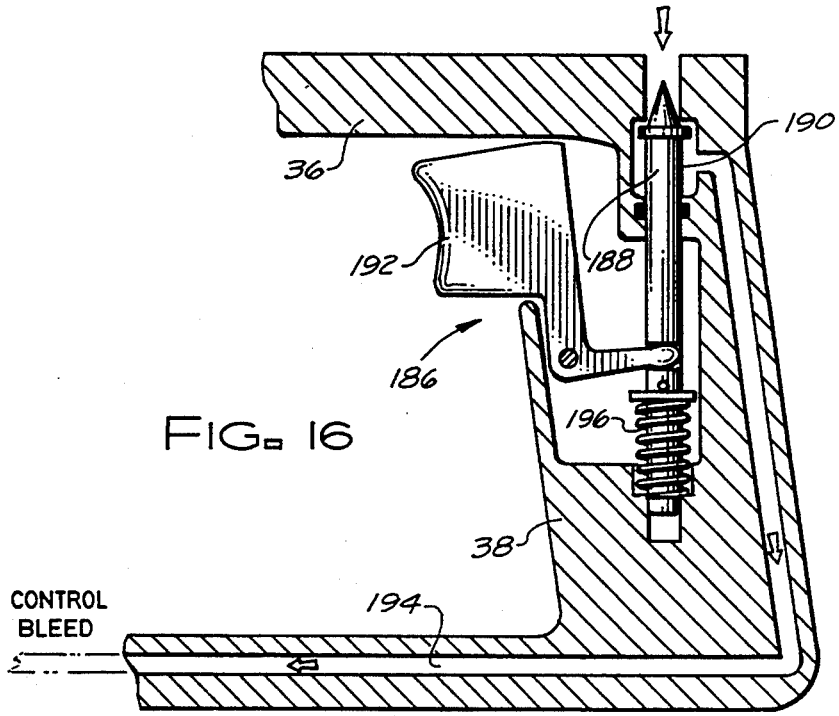
FIG. 16 is a fragmentary longitudinal cross-sectional view showing alternate actuation means for the jet spray control valve.

A modification of the actuator for the jet control valve 44 is illustrated in FIG. 16. The operating principles behind the modified actuator 186 are the same as in the actuator of FIG. 5, except that the needle valve 188 and its control chamber 190 are coaxial with, rather than perpendicular to, the outlet passage 72, and the trigger 192 is mounted for pivoting movement in the rear grip 38. In addition, the relief duct 194 extends longitudinally through the bottom guard bar 44, rather than the top support bar 36. As in the previous embodiment, however, the needle valve 188 is biased by a spring 196 toward the closed position, so that the jet valve closes automatically when the trigger 192 is released.

Figure 17:
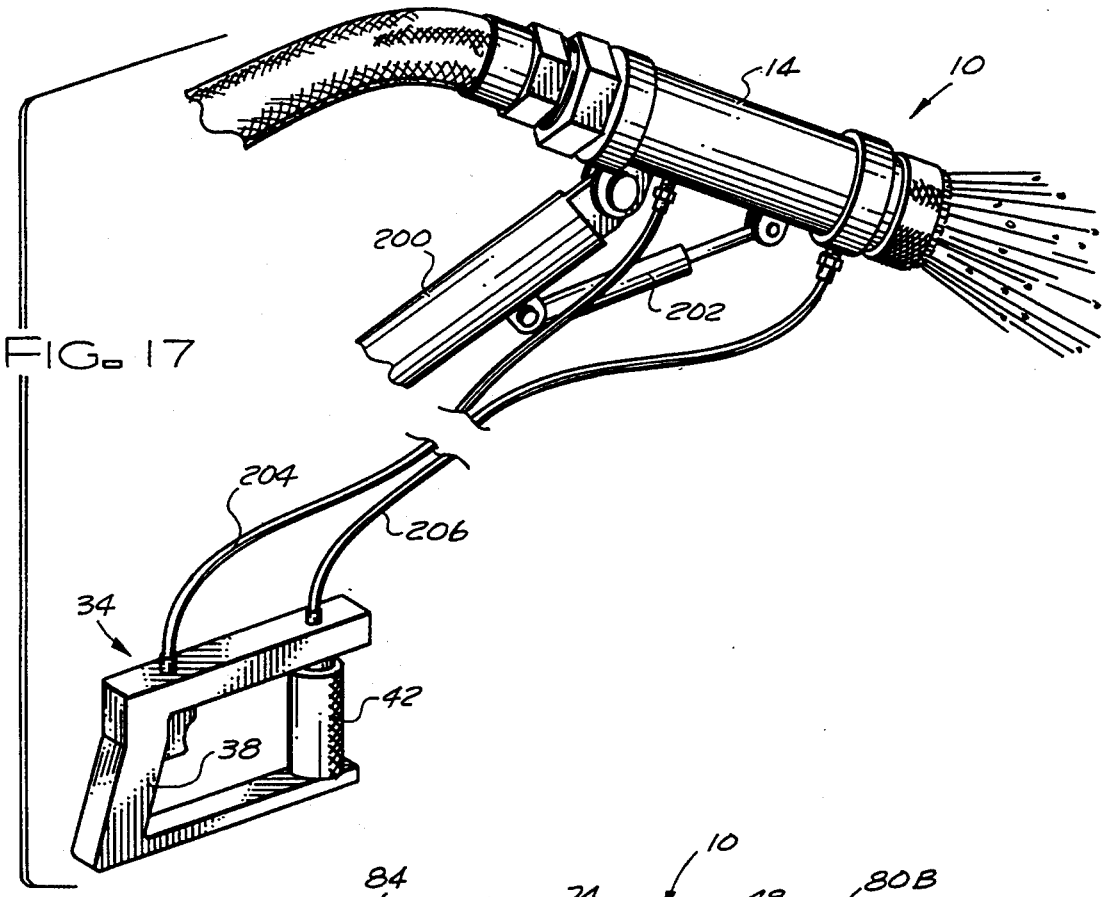
FIG. 17 is a perspective view showing an arrangement for remotely actuating a nozzle according to an alternate embodiment of the invention.

FIGS. 17–23 show a variety of alternate embodiments which allow the nozzle 10 to be operated remotely, in situations where it would be too dangerous for personnel to approach the fire directly. Specifically, FIG. 17 shows the nozzle body 14 mounted on a pair of robotic arms 200, 202. The gripping assembly 34, rather than being directly secured to the nozzle body 14 as in the previous embodiments, is in the form of a separate unit connected to the nozzle by a pair of elongated pilot lines 204, 206. Although shown here as a hand-held device, the gripping assembly 34 could take a variety of different forms, and could be incorporated as part of a control unit mounted in the dashboard of a fire truck or as part of an externally located command post.

Figure 22:
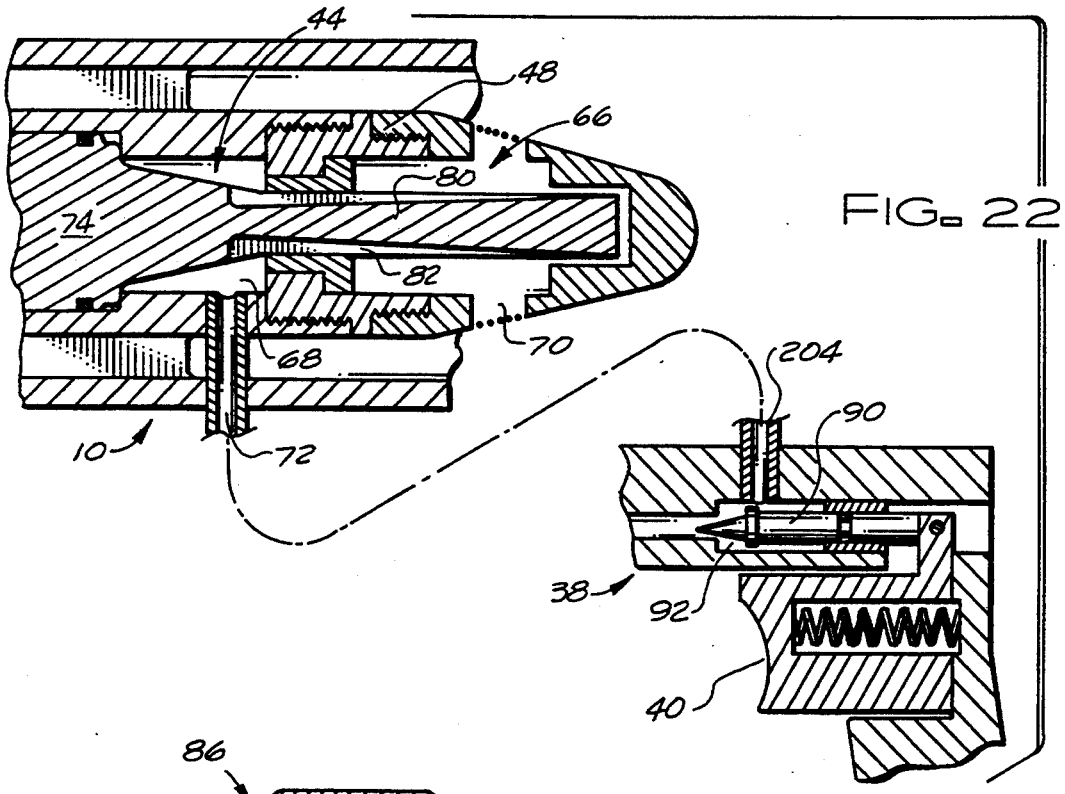
FIG. 22 is a fragmentary sectional view of the rear portion of the embodiment illustrated in FIG. 17.

FIG. 22 is a fragmentary sectional view of the rear portion of the nozzle 10 according to the embodiment of FIG. 17, showing remote actuation of the jet control valve 44. The structure and operation of the valve 44 is exactly as described in connection with FIGS. 5 and 6, except that the outlet passage 72 from the front chamber 68 of the interior valve housing 48 is coupled to the control passage 92 of the rear pistol grip 38 by means of the elongated pilot line 204, rather than leading directly thereto. A similar remote control arrangement could also be devised in connection with the embodiment of FIG. 16.

Figure 23:
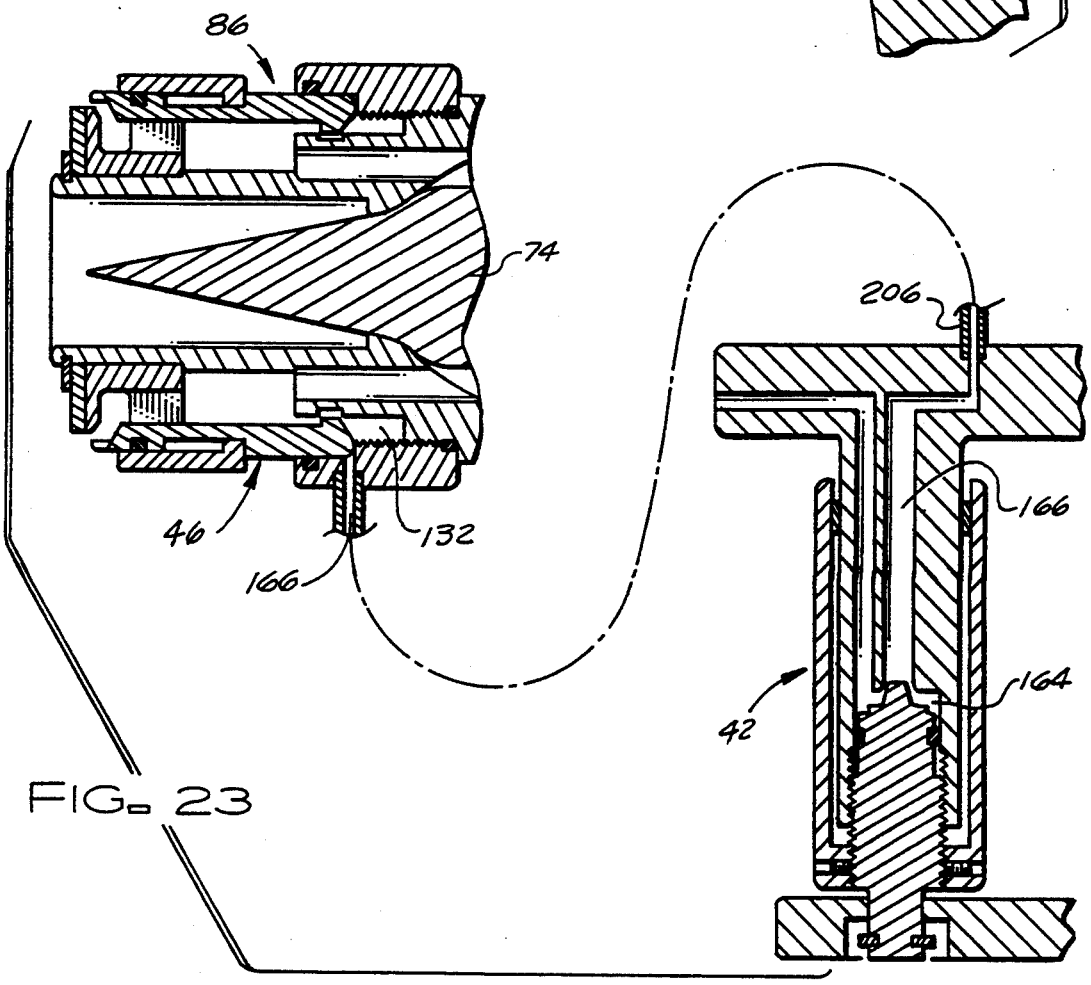
FIG. 23 is a fragmentary sectional view of the front portion of the embodiment illustrated in FIG. 17.

Similarly, FIG. 23 is a fragmentary sectional view of the front portion of the nozzle 10 according to the embodiment of FIG. 17, showing remote actuation of the fog control valve 46. The structure and operation of the valve 46 is exactly as described in connection FIGS. 10 and 11, except for the addition of the pilot line 206, which essentially extends the length of the outlet passage 166 leading from the hydraulic chamber 132 in the tip assembly 86 of the nozzle 10 to the control passage 164 in the front grip 42.

Figure 21:
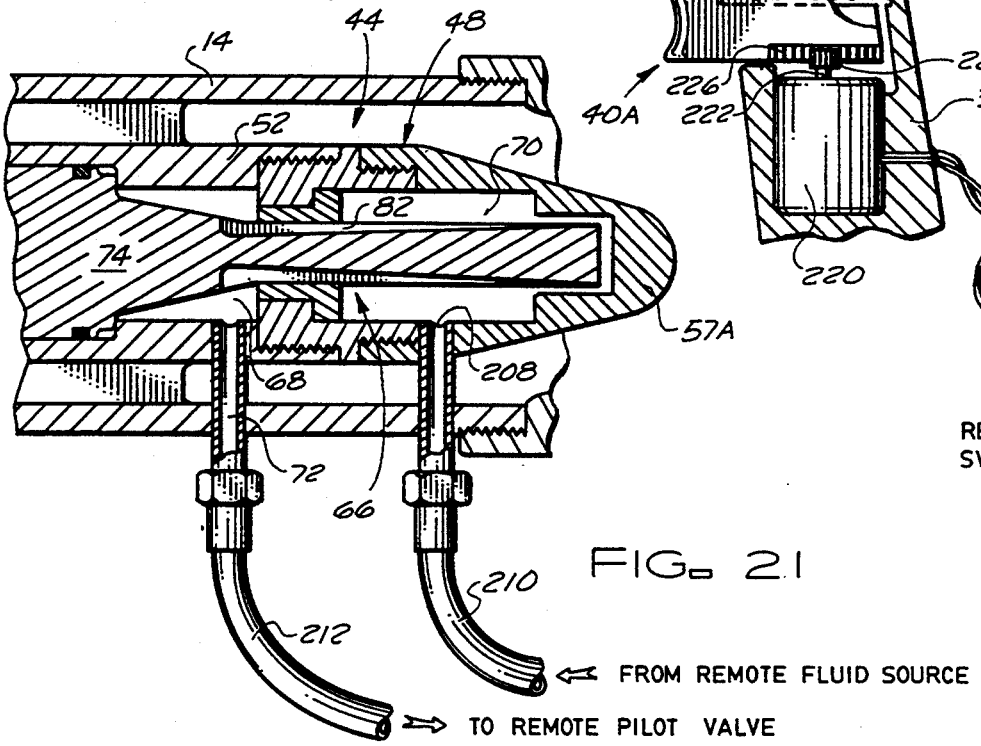
FIG. 21 is a fragmentary sectional view showing still another embodiment of the invention.

In the embodiment of FIGS. 22 and 23, as well as in the embodiment of FIGS. 1–15, the fluid used for actuating the valves 44 and 46 is the same as the liquid being dispensed from the hose—in most cases, water or a combination of water and firefighting foam. FIG. 21 shows an alternate embodiment, in which the jet control valve 44 is actuated either pneumatically or by a separate hydraulic fluid. In this embodiment, the jet control valve 44 includes a valve body 74 and an interior valve housing 48 including a front member 52 defining a front portion 68 of the hydraulic chamber 66 and a rear member 57A defining a rear portion 70 of the hydraulic chamber 66. The valve body 74, front member 52, and front portion 68 of the hydraulic chamber 66 are all identical to their counterparts in the embodiment of FIGS. 4–6. However, the rear member 57A of the interior valve housing 48 differs from the rear member 57 of the previous embodiment in that the openings 71 which admit fluid from the inlet end of the nozzle body 14 to the rear portion 70 of the hydraulic chamber 66 have been eliminated. Instead, the rear member 57A includes a single inlet port 208 which is coupled to a supply line 210 leading from a remote source of pressurized air or hydraulic fluid. The outlet passage 72 from the front portion 68 of the hydraulic chamber 70 is coupled to a return line 212 leading to a remotely located bleed valve, similar to the remote needle valve 90 of FIG. 22.

Operation of the jet control valve 44 in the embodiment of FIG. 21 is generally similar to that of the previous embodiments. That is, when the remote bleed valve is closed, the fluid pressure in the hydraulic chamber 66 is maximum, forcing the valve body 74 into its fully forward, or closed, position. When the bleed valve is opened, the pressure in the front portion 68 of the hydraulic chamber is reduced, allowing the valve body 74 to slide aft, thus opening the valve 44. As the valve body 74 moves back, the area of the grooves 82 on the tail portion 80 increases, allowing more fluid to enter the front portion 68 of the hydraulic chamber 66. Eventually, a state of equilibrium in which the rate of flow into the hydraulic chamber 66 balances the rate of flow through the bleed valve is reached, and the valve body 74 stops moving. Thus, the movement of the valve body 74 is proportional to the amount of pull on the trigger 40.

Because of the state of equilibrium which is reached in the embodiments of FIGS. 1–15, 21, and 22–23, wherein the rate of flow into the hydraulic chamber 66 equals the rate of flow out of the hydraulic chamber 66, each of these embodiments can be classified as a continuous bleed system. An alternate, non-continuous bleed system is illustrated in FIG. 18.

Figure 18:
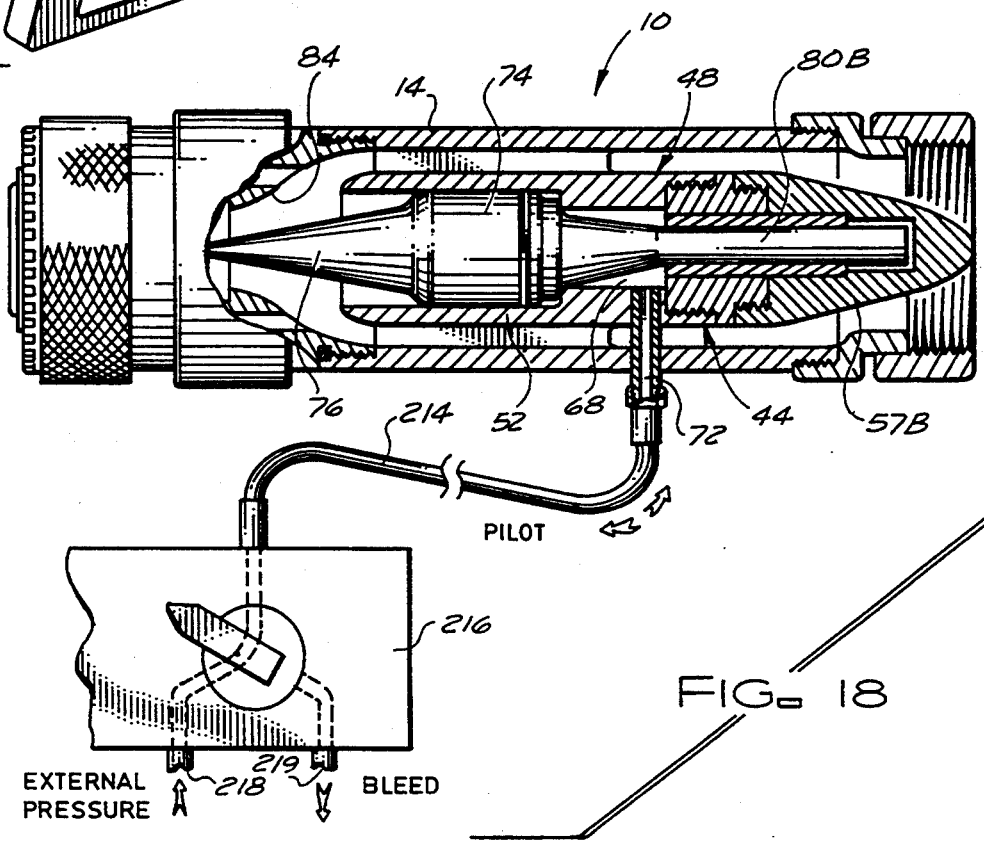
FIG. 18 is a perspective view, with a portion broken away, of another alternate embodiment of the invention.

As in the previous embodiments, the nozzle 10 of FIG. 18 includes a nozzle body or outer housing 14, an inner valve housing 48, and a valve body 74 disposed for reciprocation relative an annular valve seat 84. The front member 52 of the inner valve housing 48, as well as the front portion 76 of the valve body, are exactly as described in connection with the earlier embodiments. However, the rear member 57B of the inner valve housing 48 differs from the rear member 57 of the earlier embodiments in that the rear portion 70 of the hydraulic chamber 66 and the meshed openings 71 have been eliminated. In addition, the grooves 82 have been eliminated from the tail portion 80B of the valve body 74. The outlet passage 72 from the front portion 68 (now the only portion) of the hydraulic chamber is coupled to a pilot line 214, which is coupled to a three-way valve 216. The three-way valve 216 is movable between a first position which couples the pilot line 214 to an external source 218 of pressurized fluid, a second position which couples the pilot line 214 to a bleed passage 219, and a third or "off" position which shuts off flow to and from the pilot line 214. When the valve 216 is in its first position, the pressurized fluid enters the hydraulic chamber 68, forcing the valve body 74 toward the valve seat 84 to close the jet control valve 44. When the valve 216 is in its second position, the fluid leaves the hydraulic chamber 68, causing the pressure in the chamber 68 to drop and the valve body 74 to move aft, opening the jet control valve 44. When the valve 216 is in its third position, the valve body 74 stops moving and the jet control valve 44 stays in its current state.

Figure 20:
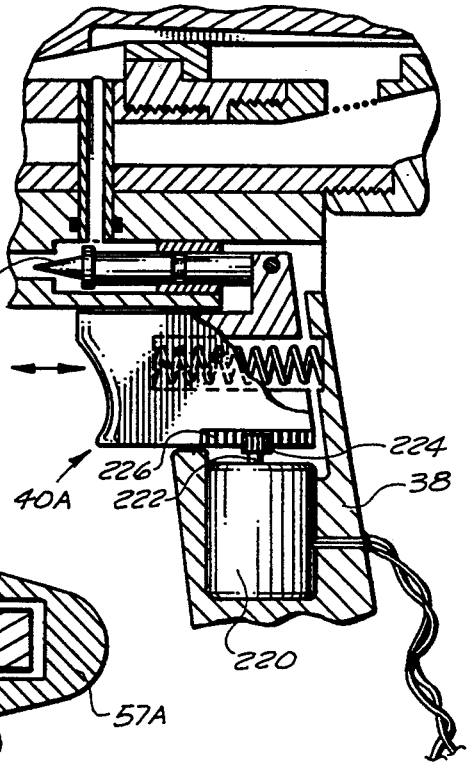
FIG. 20 is a fragmentary sectional view showing still another embodiment of the invention.

FIG. 20 shows an alternate trigger mechanism 40A which may replace the manually actuated trigger 40 in the embodiment of FIGS. 1–15 or the embodiment of FIGS. 17 and 22. As in the previous embodiments, the trigger 40A is movably mounted in the rear grip 38 of the gripping assembly 34 and mechanically coupled to the needle valve 90. Reciprocation of the trigger 40A is controlled by a motor 220 housed within the rear grip 38. The output shaft 222 of the motor 220 includes a number of gear teeth 224 which mesh with corresponding teeth 226 formed on the lower surface of the trigger 40A. The motor 220 is actuated by a remotely located switch, allowing a firefighter to operate the jet control valve 44 at a safe distance away from the fire.

Figure 19:
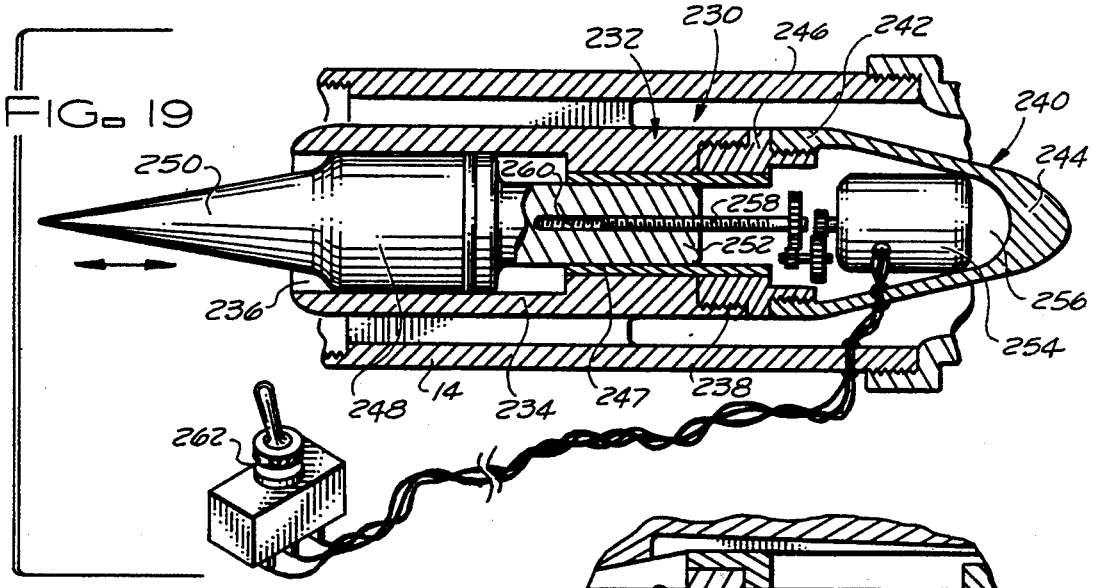
FIG. 19 is a sectional view showing yet another embodiment of the invention.

Finally, FIG. 19 shows an alternate, electrically operated jet control valve 230 which may replace the hydraulically operated jet control valve 44 of any of the previous embodiments. The valve comprises an interior valve housing 232 including a front member 234 having an open front end 236 and an internally threaded, open back end 238; a sealed rear member 240 having an internally threaded, open, front end 242 and a closed back end 244; and a central connector member 246 having both ends externally threaded for cooperation with the corresponding internally threaded ends of the front and rear members 234, 240. A sleeve bearing 247 is carried in the bore of the connector member 246.

A valve body 248 having a forwardly tapered front end 250 is mounted for longitudinal translation within the open front end 242 of the front member 234 of the valve housing 232. The valve body 248 includes an elongated tail portion 252 which extends rearwardly through the sleeve bearing 247.

An electric motor 254 is mounted within a chamber 256 formed in the rear member 240 of the interior valve housing 232. The output shaft of the motor 254 is coupled by several differential gears to a lead screw 258 which extends into a threaded bore 260 in the tail portion 252 of the valve body 248. Rotation of the lead screw 258 is converted to longitudinal movement of the valve body 248 toward and away from the valve seat, in a manner similar to the earlier embodiments. Activation of the motor 254 is controlled by a switch 262, which can either be located remotely, as shown, or mounted on a grip depending from the nozzle body 14.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A firefighting nozzle comprising a hollow nozzle body having:
   a) an open inlet end for receiving a liquid from a hose;
   b) an outlet end including a jet orifice for discharging at least a portion of said liquid in a form of a circular solid stream having a variable diameter;
   c) jet control means disposed within said orifice for selectively varying said diameter; and
   d) actuator means utilizing fluid pressure to actuate said jet control means.

2. A firefighting nozzle according to claim 1, wherein
   a) said jet control means comprises
      i) an interior housing carried within said nozzle body and defining a hydraulic chamber,
      ii) a valve body mounted for longitudinal translation within said hydraulic chamber, said valve body having a rear surface subject to forward pressure from a fluid in said hydraulic chamber, and
      iii) a valve seat formed proximate said outlet end of said nozzle body; and
   b) said actuator means comprises
      i) inlet means in said interior housing for admitting said fluid into said hydraulic chamber;
      ii) an outlet passage for discharging said fluid from said hydraulic chamber, and
      iii) secondary valve means for selectively varying flow through said outlet means.

3. A firefighting nozzle according to claim 2, wherein said fluid is the liquid received from said hose, and said inlet means comprises at least one opening in said interior housing communicating with said inlet end of said nozzle body.

4. A firefighting nozzle according to claim 2, wherein said fluid is separate from said liquid, and said inlet means comprises:

a) at least one opening in said interior housing, and b) a tube connecting said opening to a remote exterior source of said fluid.

5. A firefighting nozzle according to claim 2, further comprising manual control means for controlling operation of said secondary valve means.

6. A firefighting nozzle according to claim 5, wherein said manual control means is located remotely from said nozzle body.

7. A firefighting nozzle according to claim 5, wherein said manual control means comprises a trigger grip.

8. A firefighting nozzle according to claim 2, wherein said secondary valve means comprises a needle-type metering valve mounted for reciprocation relative said outlet passage.

9. A firefighting nozzle according to claim 2, further comprising electric control means for controlling operation of said secondary valve means.

10. A firefighting nozzle according to claim 9, wherein said electric control means comprises an electrically actuated trigger grip.

11. A firefighting nozzle according to claim 2, further comprising remote control means located away from said nozzle body for controlling operation of said secondary valve means.

12. A firefighting nozzle according to claim 11, wherein:

a) said outlet passage comprises an elongated tube having an inlet end communicating with said hydraulic chamber, and an outlet end extending to a remote external location; and b) said secondary valve comprises a needle-type metering valve mounted for reciprocation relative said outlet passage, at a location distinct from the nozzle housing.

13. A firefighting nozzle according to claim 1, wherein:

a) said jet control means comprises i) an interior housing carried within said nozzle body and defining a hydraulic chamber, ii) a valve body mounted for longitudinal translation within said hydraulic chamber, said valve body having a rear surface subject to forward pressure from a fluid in said hydraulic chamber, and iii) a valve seat formed proximate said outlet end of said nozzle body; and b) said actuator means comprises remotely actuated means for selectively controlling the pressure of fluid in said hydraulic control chamber to move said valve body relative said valve seat.

14. A firefighting nozzle according to claim 13, wherein said remotely actuated means comprises:

a) an opening in said interior housing communicating with said hydraulic chamber;

b) an elongated duct having a first end and a second end, said first end communicating with said opening;

c) a remotely located source of pressurized fluid; and d) a three-way valve located between said second end of said duct and said source of fluid, said three-way valve being movable from a first position allowing said second end of said duct to communicate with said source of fluid to a second position allowing said second end of said duct to communicate with a drainage port;

wherein said duct supplies said fluid to said hydraulic chamber when said three-way valve is in said first position, causing said valve body to move toward said valve seat, and said duct allows said fluid to bleed from said hydraulic chamber, when said three-way valve is in said second position, causing said valve body to move away from said valve seat.

15. A firefighting nozzle according to claim 1, wherein said outlet end further comprises an annular fog control opening surrounding said jet orifice for discharging a second portion of said liquid in the form of a conical stream of evenly distributed liquid droplets of variable intensity.

16. A firefighting nozzle according to claim 15, further comprising:

a) fog control means, disposed within said fog spray opening, for selectively varying said intensity; and b) second actuator means utilizing fluid pressure to actuate said fog control means independently of said jet control means.

17. A firefighting nozzle comprising a hollow nozzle body having:

a) an open inlet end for receiving liquid from a hose;

b) an outlet end including a jet orifice, for discharging at least a portion of said liquid in the form of a circular solid stream having a variable diameter; and c) jet control means disposed within said jet orifice for selectively varying said diameter, said jet control means including i) a valve body mounted for longitudinal translation within said nozzle body, ii) a valve seat formed proximate the outlet end of said nozzle body, and iii) drive means utilizing fluid pressure for moving said valve body relative said valve seat to vary said diameter.

18. A firefighting nozzle according to claim 17, wherein said drive means includes a remotely located actuator for allowing said jet control means to be operated from a position distant from the nozzle body.

* * * * *

UNITED STATES PATENT AND TRADEMARK OFFICE

CERTIFICATE OF CORRECTION

PATENT NO. : 5,447,203
DATED : September 5, 1995
INVENTOR(S) : McLoughlin et al.

It is certified that error appears in the above-indentified patent and that said Letters Patent is hereby corrected as shown below:

On the cover page, under "Related U.S. Application Data", the portion reading "Jul. 11, 1979" should read - Jul. 17, 1991 - .

Signed and Sealed this

Thirtieth Day of January, 1996

*Attest:*

*Attesting Officer*

BRUCE LEHMAN

*Commissioner of Patents and Trademarks*